United States Patent [19]

Sakai et al.

[11] 4,444,866

[45] Apr. 24, 1984

[54] PHOTOGRAPHIC LIGHT-SENSITIVE MATERIAL WITH FORCED OXIDIZED CARBON BLACK

[75] Inventors: Takeo Sakai; Mitsugu Tanaka; Shigetoshi Ono; Seiji Suzuki; Hirohisa Suzuki, all of Kanagawa, Japan

[73] Assignee: Fuji Photo Film Co., Ltd., Kanagawa, Japan

[21] Appl. No.: 471,918

[22] Filed: Mar. 3, 1983

Related U.S. Application Data

[63] Continuation-in-part of Ser. No. 258,343, Apr. 28, 1981, abandoned.

[30] Foreign Application Priority Data

Apr. 28, 1980 [JP] Japan ..... 55-56424

[51] Int. Cl.[3] ..... G03C 7/00; G03C 1/84; G03C 1/72; G03C 1/02

[52] U.S. Cl. ..... 430/220; 430/264; 430/270; 430/271; 430/495; 430/517; 430/564; 430/570

[58] Field of Search ..... 430/220, 517, 510, 227, 430/229, 270, 271, 264, 338, 154, 56, 502, 495, 541, 542, 570, 564

[56] References Cited

U.S. PATENT DOCUMENTS

| | | | |
|---|---|---|---|
| 3,276,871 | 10/1966 | Abbott | 430/517 |
| 3,900,323 | 8/1975 | MacLeish et al. | 430/510 |
| 4,076,531 | 2/1978 | Crowell | 430/264 |
| 4,272,594 | 6/1981 | George et al. | 430/220 |

OTHER PUBLICATIONS

Donnet et al., *Carbon Black,* Marcel Dekker Inc., New York, 1976, pp. 12–17 and 129–131.

Myers et al., *Treatise on Coatings,* vol. 3, Pigments, Marcel Dekker Inc., New York, ©1975, pp. 261–283.

"Photographic Processes and Products," *Research Disclosure,* No. 15162, 11/1976, pp. 75–87.

*Primary Examiner*—Richard L. Schilling

*Attorney, Agent, or Firm*—Sughrue, Mion, Zinn, Macpeak and Seas

[57] ABSTRACT

Photographic light-sensitive materials particularly useful in connection with instant photography are disclosed. The disclosed photographic materials include films for instant photography which have a reduced image appearing time, a high Dmax and low Dmin. The disclosed materials include force-oxidized carbon black in liquid phase, which has a dispersibility of at least 4 in water.

12 Claims, No Drawings

PHOTOGRAPHIC LIGHT-SENSITIVE MATERIAL WITH FORCED OXIDIZED CARBON BLACK

CROSS REFERENCE TO RELATED APPLICATION

This is a continuation-in-part application of Ser. No. 258,343 filed Apr. 28, 1981, now abandoned.

FIELD OF THE INVENTION

This invention relates to the field of photographic light-sensitive material and, more particularly, to a silver halide photographic light-sensitive material containing carbon black which has been force-oxidized in a liquid phase.

BACKGROUND OF THE INVENTION

Color diffusion transfer process photographic light-sensitive materials have been put into practice as "instant" photographic materials. Such materials make it possible to enjoy color photographic picture immediately after photographing. These types of light-sensitive materials are designed so that they are extruded out of a camera (or dark box) immediately after taking a picture. This permits a photographer to consecutively release the shutter. With light-sensitive materials of this type, a light-sensitive layer is designed to be sandwiched, after photographing, between two light-sealed (or sealing) layers usually containing carbon black so as to protect it from the following deleterious exposure. Carbon blacks employed in the prior art light-sealing layers are not subjected to "forced oxidation" (later defined) though some carbon blacks inherently undergo oxidation during their production; however, such oxidation inherent to a manufacturing process is fundamentally different from "forced oxidation" as is called for in the present invention. To distinguish such inherent oxidation from and as opposed to "forced oxidation," the term "nontreated" is often used hereafter to refer to carbon blacks commercially available, some of which are inherently oxidized during a manufacturing process. Light-sensitive materials designed as described above have long been proposed and described, for example, in U.S. Pat. No. 3,053,659.

However, formation of the light-sealed (or sealing) layers using non-treated carbon black has involved the defect that, upon production and during storage of the light-sensitive materials, the light-sealed (or sealing) layers adversely influence a silver halide emulsion layer in the vicinity thereof by increasing the minimum desity (Dmin) or decreasing the maximum density (Dmax) of the resulting transfer image. This defect is particularly serious when "direct positive emulsion of the type not previously fogged" is used as a silver halide emulsion. Also, formation of the light-sealed (or sealing) layers using non-treated carbon black has involved the defect that, upon diffusing of transferred dyes through the layers, the dyes are captured by (or adsorbed on) carbon black. This results in a decrease in the maximum density of the transferred dye image or delayed appearance of the image.

U.S. Pat. No. 3,900,323 proposes to add water-soluble salts of heavy metals such as cadmium or lead to the carbon black-containing layer for preventing formation of fog due to the use of carbon black. However, the use of such heavy metal salt can cause environmental pollution and, in addition, involves the technical problem that it is difficult to control the amount of heavy metal salt to the lot-to-lot change in the amount of impurities (sulfur compounds) in carbon black. Further, when the heavy metal salt is used in excess amount, the heavy metal salt itself adversely influences photographic properties decreasing photographic sensitivity (leading to fluctuation in photographic quality due to lot-to-lot variation of carbon black).

Carbon black being available on a market has a particle size of 0.018 to 0.12$\mu$. Among above-mentioned carbon blacks, the carbon black having a particle size of 0.018 to 0.030$\mu$ is unsuitable for incorporated into a light-sealed (or sealing) layer, because the surface area of said carbon black being large, the dye adsorption of said carbon black is much.

*Research Disclosure,* No. 15162, page 83, November (1976) discloses diffusion transfer films containing carbon black, particularly noting that it is preferred that carbon black particles have non-oxidizing surfaces. This is assumed to be because that oxidized surfaces would adversely affect an oxidation reduction mechanism in photographic systems. Further, it is known by Myers et al, *Pigments,* vol. 3, page 275, published by Marcel Dekker (1975) that oxidation produces an increase in surface area and, based on this established knowledge, it is highly likely that the *Research Disclosure* article teaches to avoid the use of carbon black particles having an oxidized surface. According to the Meyers et al article, air oxidation of carbon black particles produces as much as a 6 to 8 times increase in surface area. Carbon black particles having such a large surface area are not effective for the use of the present invention.

In addition, the use of carbon black is disclosed in U.S. Pat. Nos. 4,272,594 issued to George et al, 3,267,871 issued to Abott, 3,900,323 issued to MacLeish et al and 4.076,531 issued to Crowell; however, carbon black used therein are all non-treated carbon atoms and involve disadvantages as will later be demonstrated in comparative examples.

SUMMARY OF THE INVENTION

An object of the present invention is to provide a photographic light-sensitive material containing carbon black obtained by forced oxidation which provides a good image quality without adversely affecting photographic properties.

Another object of the present invention is to provide a photographic light-sensitive material containing force-oxidized carbon black which can shorten an image-appearing time and raise $D_{max}$, particular $D_{max}$ of red, along with a remarkable reduction in $D_{min}$.

DETAILED DESCRIPTION OF THE INVENTION

The above-described objects can effectively be attained by a photographic light-sensitive material containing force-oxidized carbon black in a liquid phase.

The starting material for the carbon black used in the practice of the present invention include non-treated carbon blacks prepared by optional processes, such as thermal black and furnace black. The particle size of the carbon black is chosen to have 0.03$\mu$ to 0.12$\mu$. The particle size of the carbon black is more preferably 0.05 to 0.12$\mu$. Channel black has a too small particle size outside the above described range and does not provide desirable effects.

Force-oxidation is effected by reacting an oxidizing agent in a liquid phase on non-treated carbon black. As opposed to the prior art inherent oxidation which gives non-treated carbon black, the forced oxidation of such non-treated carbon black in a liquid phase does not change a particle size of the force-oxidized carbon black; in other words, the particle size of the starting carbon black (non-treated) is maintained even after the force oxidation. This indicates that the force oxidation which non-treated carbon black undergoes is quite dissimilar to oxidation inherent to its production which the prior art carbon black undergoes.

The force oxidation is effected by oxidation in a liquid phase using particular oxidizing agents. Specific examples of the oxidizing agents that can be used in the present invention include peroxides such as peracetic acid, potassium persulfate, sodium persulfate, ammonium persulfate, hydrogen peroxide; acids with an oxidizing power such as nitric acid; and metal salts except heavy metal salts of hypohalogenites. When using these oxidizing agents, it is preferable to heat to, particularly, about 40° C. to about 100° C. The pH during the oxidation reaction can optionally be selected from the range of acidity and alkalinity depending upon the kind of oxidizing agent used.

The degree to which the carbon black is force-oxidized can be properly determined by dispersibility of carbon black in water. In the present invention, carbon black having dispersibility of at least 4, preferably 4 to 20, more preferably 6 to 15.

The term "dispersibility" as used herein is a parameter for distinguishing the force-oxidized carbon black over non-treated starting carbon black and refers to a value expressed by an extinction density increased by 10 times, which is determined by charging 0.1 g of carbon black and 100 ml of water in an Erlenmeyer's flask, vigorously shaking the flask for 5 minutes (200/min), then allowing to stand for 24 hours, withdrawing 5 ml of the supernatant and then adding 95 ml of water to the supernatant, measuring absorption of the resulting liquid at a visible region to determine an extinction density at 500 mμ (10 mm cell, using water as a control), and then increasing the extinction density by ten times. If the dispersibility of carbon black is less than 4, poor Dmax results are obtained. Details are described in Experiment Example under the title of "Measurement of dispersibility."

The liquid phase-force-oxidized carbon black having the above defined dispersibility adsorbs dye (I) in a specific amount. The amount of adsorbed dye (I) is another guide to decide the degree to which the carbon black is force-oxidized, and is measured under the conditions to be described in Experiment Example described hereinafter under the title of "Measurement of the amount of dye (I) adsorbed on carbon black." Carbon black having the above defined dispersibility adsorbs, as compared to non-treated carbon black, 75% or less, preferably 65 to 10%, of the following dye (I) on the treated (i.e., force-oxidized) carbon black.

Dye [I]

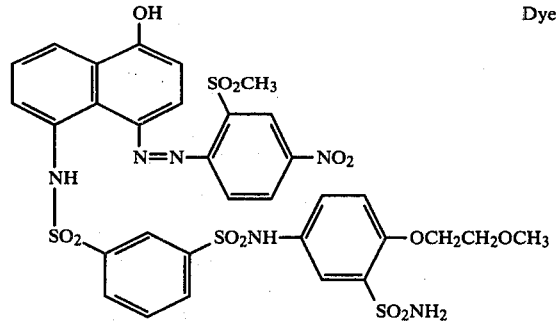

Of the above described oxidizing agents, the use of a hypohalogenite (except heavy metal salts) is particularly preferred.

Preferred examples of hypohalogenites include alkali metal salts and alkaline earth metal salts of hypohalogenous acids. More specifically, there are illustrated sodium hypochlorite, sodium hypobromite, sodium hypoiodite, potassium hypochlorite, potassium hypobromite, potassium hypoiodite, calcium hypochlorite, etc. Of these, sodium hypochlorite is particularly preferred.

Carbon black force-oxidized in a liquid phase can be prepared by adding the aforesaid oxidizing agent to an aqueous dispersion of non-treated carbon black and force-oxidizing it through heating or the like. When such a liquid phase reaction is employed, after-treatment with a reducing agent which slightly influences photographic properties such as sodium sulfite, ascorbic acid, glucose, sucrose, or the like is preferable. The reduction agent is useful in removing detrimental influences of any remaining oxidizing agent. However, the thus obtained carbon black aqueous dispersion must be subjected to the steps of removing reaction products of the oxidizing agent and reducing agent deleteriously influencing photographic properties. For this purpose, procedures of filtration→washing with water→filtration must be repeated. However, force-oxidized carbon black has an increased affinity to water, thus filtration requiring a long time. Another process utilizes a semi-permeable membrane. However, with this process the removal of the reaction products requires a long time and a large amount of water is necessary.

These difficulties can effectively be removed by adding gelatin to the force-oxidized carbon black aqueous dispersion to prepare a gelatin dispersion, and washing away the aforesaid reaction products according to a noodle-washing method or a flocculation method. The noodle-washing method and flocculation method are well known as methods for removing soluble salts in preparing a gelatino-silver halide emulsion. The noodle-washing method is a method of gelatinizing a gelatin aqueous solution, cutting the gelatinized product into die or noodle pieces, and washing the pieces with water. The flocculation method is a method of flocculating gelatin using an inorganic salt comprising a polyvalent anion (e.g., sodium sulfate), an anionic surfactant, an anionic polymer (e.g., polystyrenesulfonic acid), or a gelatin derivative (e.g., aliphatically acylated gelatin, aromatically acylated gelatin, or aromatically carbamoylated gelatin) followed by washing with water.

In dispersing force-oxidized carbon black in water in the aforesaid process, it is preferable to use a dispersing agent well known in the technical field of dispersing pigments. The use of such a dispersing agent results in uniform fine-particled dispersion by merely mixing the carbon black with water. As the preferable dispersing agent, anionic or nonionic substances can be used. For example, various surfactants and polymers such as alkylcarboxylates, alkylsulfonates, alkylbenzenesulfonates, naphthalenesulfonates, alkylnaphthalenesulfonates, alkylsulfuric esters, sulfoalkylpolyoxyethylene alkylphenyl ethers, polyoxyethylene alkyl ethers, polyoxyethylene alkylphenyl ethers, a condensate between formaldehyde and naphthalenesulfonate, polystyrenesulfonates, polyvinyl alcohol, hydroxyethyl cellulose, carboxymethyl cellulose, arginine are useful. The anionic substances are more preferred and the condensate between formaldehyde and naphthalenesulfonate is particularly preferred.

The carbon black force-oxidized according to the above-described process is dispersed, if desired, in the presence of a dispersing agent, and an auxiliary coating agent, water-soluble binder, hardener, etc., are added thereto followed by coating the resulting mixture as an light-sealed (or sealing) layer.

As the water-soluble binder, gelatin is advantageously used, but other hydrophilic colloids are also usable. For example, there can be used gelatin derivatives, graft polymers between gelatin and other high molecular weitht polymers, proteins (e.g., albumin, casein, etc.); cellulose derivatives (e.g., hydroxyethyl cellulose, carboxymethyl cellulose, cellulose sufate, etc.); sugar derivatives (e.g., sodium alginate, starch derivative, etc.); various synthetic hydrophilic high molecular weight polymers such as homopolymers (e.g., polyvinyl alcohol, partially acetalized polyvinyl alcohol, poly-N-vinylpyrrolidone, polyacrylic acid, polyvinylimidazole, polyvinylpyrazole, etc.) and copolymers derived from the monomer components of the homopolymers; etc.

Examples of suitable gelatins include: acid-processed gelatin and enzyme-processed gelatin described in *Bull. Soc. Sci. Phot. Japan,* No. 16, p. 30 (1966) as well as lime-processed gelatin. Further, gelatin hydrolysis products and enzymatically decomposed products are also usable.

As the gelatin derivatives, there are used those obtained by reacting gelatin with various compounds such as acid halides, acid anhydrides, isocyanates, bromoacetic acid, alkanesultones, vinylsulfonamides, maleimides, polyalkylene oxides, epoxy compounds, etc.

To the aforesaid light-sealed (or sealing) layer may be added various synthetic latex polymers. For example, there can be used latex polymers containing, as monomer ingredients, alkyl acrylate or methacrylate, acrylic acid, and sulfoalkyl acrylate or methacrylate. Specific examples thereof are described in U.S. Pat. Nos. 3,142,568, 3,193,386, 3,062,672, 3,220,844, etc.

The force-oxidized carbon black of the present invention can also be used as carbon black to be incorporated in a processing solution. In this case, the use of gelatin-free carbon black aqueous dispersion is preferable. The amount of carbon black is suitably 0.08 g to 0.3 g per 1 g of the processing solution.

By means of the force-oxidation as described above, it seems that water-soluble radicals

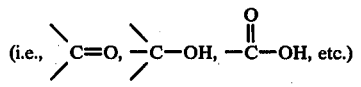

are provided on a surface of carbon black. The effects contemplated in the present invention, however, are merely attributed to the provision of such water-soluble radicals, but to the fact that the degree of the force oxidation is properly controlled within the range set forth in terms of the dispersibility of carbon black in water, while a mechanism is not exactly clear.

The photographic light-sensitive material of the present invention is useful for purposes such as a photographic film unit for a color diffusion transfer process. The photographic light-sensitive material having the following constitution is particularly effective: a photographic film unit for color diffusion transfer process comprising at least a transparent support, an image-receiving layer, a silver halide emulsion layer associated with a dye image-providing compound, and a pressure-rupturable container retaining a processing solution, wherein the force-oxidized carbon black is incorporated in a layer between a second support or said image-receiving layer and said silver halide emulsion layer or in said processing solution.

Typical embodiments of the photographic film unit of the present invention of a color diffusion transfer process include the following:

(1) A film unit wherein a light-sensitive sheet comprising a transparent support having provided thereon, in sequence, an image-receiving layer, white reflecting layer (containing titanium oxide or the like), a light-sealed (or sealing) layer containing the force-oxidized carbon black, a layer containing a cyan dye image-providing compound, a red-sensitive silver halide emulsion layer, an interlayer, a layer containing a magenta dye image-providing compound, a green-sensitive silver halide emulsion layer, an interlayer, a layer containing a yellow dye image-providing compound, a blue-sensitive silver halide emulsion layer, and a protective layer superposed in a face-to-face relation on a cover sheet comprising a second transparent support having provided thereon a neutralizing layer and a timing layer, and wherein a pressure-rupturable container retaining a carbon black-containing processing solution is disposed in such a position that a processing solution can be spread between the above-described two sheets, with these three elements being fixed to form a unit.

This film unit constitution has so far been well known except for the use of the force-oxidized carbon black. Detailed descriptions of such film unit are given in, for example, *Photographic Science and Engineering,* Vol. 20, No. 4, pp. 155 to 164 (July/August 1976). The reaction mechanism of how transferred images can be obtained by the film unit is also described therein in detail.

(2) A film unit wherein an image-receiving sheet comprising a transparent support having provided thereon a neutralizing layer, a timing layer, and an image-receiving layer is superposed in a face-to-face relation on a light-sensitive sheet comprising a transparent or light-sealed (or sealing) second support having provided thereon in sequence a light-sealed (or sealing) layer containing the force-oxidized carbon black, a layer containing a cyan dye image-providing compound, a red-sensitive silver halide emulsion layer, an interlayer, a layer containing a magenta dye image-providing compound, a green-sensitive silver halide emulsion layer, an interlayer, a layer containing a yellow dye image-providing compound, a blue-sensitive silver halide emulsion layer, and a protective layer, and wherein a pressure-rupturable container retaining a plurality of pH-indicator dyes and titanium oxide is located in such position that the processing solution can be spread between two sheets, with these three elements being fixed to form a film unit.

This film unit constitution is well known except for the use of the force-oxidized carbon black. The film unit without the force-oxidized carbon black is described in detail in, for example, Neblettes' *Handbook of Photography and Reprography Materials, Processes and Systems,* 7th Edition (1977), Chapter 12. The reaction mechanism of how transferred images can be obtained by this film unit is also described therein in detail. The aforesaid pH-indicator dyes are specifically described, for example, in U.S. Pat. Nos. 3,647,437 and 3,833,615.

The stratum structure of the above-described embodiments (1) and (3) may properly be varied. For example, the dye image-providing compound and silver halide may be incorporated in the same layer.

On the other hand, the timing layer may be made of a plurality of sub-layers, and the carbon black to be used in the processing solution in the embodiment (1) may be the one having been similarly forced-oxidized.

A preferable stratum structure of the embodiment (1) comprises a light-sealed (or sealing) layer containing the force-oxidized carbon black and a layer containing the force-oxidized carbon black and a cyan dye image-providing compound. That is, the layer containing a cyan dye-image providing compound preferably contains at least a part of the force-oxidized carbon black.

The present invention provides the following effects.

(1) Dyes which diffuse and transfer to an image-receiving layer are captured to a lesser extent, by the force-oxidized catbon black-containing layer. This accelerates the transfer of dyes. As a result, the time it takes for an image to appear in the image-receiving layer is shortened. Furthermore, the resulting transferred image has a high Dmax.

(2) Photographic properties are not deteriorated by the force-oxidized carbon black (there are obtained transferred images with a low Dmin and a high Dmaz.).

(3) The carbon black of the present invention can be added to a layer containing a dye image-providing compound, and hence the film can be made thinner than in the case of incorporating carbon black and the dye image-providing compound in different layers. The use of the single layer serves to accelerate transfer of dyes. As a result, a transferred image appears in a shorter time. This is desirable for the purposes of "instant photography."

(4) Aggregates of carbon black particles are decreased. This improves the light-interrupting properties of the light-sealed (or sealing) layer. As a result, the amount of the carbon black can be reduced in the present invention as compared to the conventional carbon black. This is economically advantageous and also makes it possible to make the film thinner, which makes it possible to form a transferred image in less time.

(5) Dark-heat increases in color (an increase in color density of dye image formed in an image-receiving layer after development processing) of, particularly, cyan can be prevented.

(6) Frame blotting (blotting of a white frame of a print with an oozing dye) of, particularly, a cyan dye can be prevented.

In addition, the photographic light-sensitive material of the present invention is useful as a light-sensitive material for forming a wash-off refief iamge. The mechanism how this light-sensitive material forms an image is described in U.S. Pat. Nos. 3,440,049, 4,076,5331, etc. When forming a wash-off relief image in accordance with the present invention, the force-oxidized carbon black is effectively incorporated in an antihalation layer. The photographic light-sensitive material of the present invention is also useful as a pan-matrix film. When forming a pan-matrix film, the force-oxidized carbon black is effectively incorporated in a silver halid emulsion layer. A conventional pan-matrix film is described, for example, in P. Glafkides: *Photographic Chemistry,* Vol. 2, pp. 689 to 701 (Fountain Press, 1960) and *Kodak Color Data Book* (subtitle: Kodak Dye Transfer Processes), (1951).

Silver halid emulsions useful in the photographic light-sensitive material of the present invention are hydrophilic colloid dispersions of silver chloride, silver bromide, silver chlorobromide, silver bromoiodide, silver chlorobromoiodide or mixtures thereof. The halogen composition is selected depending upon the end-use of the light-sensitive material and processing conditions. Silver bromide, silver bromoiodide or silver chlorobromoiodide containing 10 mole % or less iodide and 30 mole % or less chloride is particularly preferable.

In the present invention, either of "surface latent image type" silver halide emulsions forming latent image mainly on the surface of silver halide grains and "internal latent image" type silver halide emulsions forming latent image mainly within grains may be used, with the latter being particularly preferable. As the internal latent image type silver halide emulsion, there are illustrated conversion type emulsions, core/shell type emulsions and emulsions containing differen metals, described in U.S. Pat. Nos. 2,592,250, 3,206,313, 3,447,927, 3,761,276, 3,935,014, etc.

The emulsions as mentioned above are preferable for obtaining a direct positive image by developing in the presence of a nucleating agent after imagewise exposure. Typical examples of the nucleating agents include hydrazines described in U.S. Pat. Nos. 2,588,982 and 2,563,785; hydrazides and hydrazones described in U.S. Pat. No. 3,227,552; quaternary salt compounds described in British Patent 1,283,835, Japanese Patent Publication No. 38164/74, U.S. Pat. Nos. 3,734,738, 3,719,494, 3,615,615; sensitizing dyes having in the dye molecule a nucleating substituent, which acts to fog the materials, described in U.S. Pat. No. 3,718,470; and acylhydrazinophenylthiourea compounds described in U.S. Pat. Nos. 4,030,925 and 4,031,127. The acylhydrazinophenylthiourea compounds described in U.S. Pat. No. 4,031,127 are more preferred.

The light sensitivity of the silver halide emulsions to be used in the present invention may have, if desired, be expanded with a spectrally sensitizing dye. Examples of useful spectrally sensitizing dyes include cyanine dyes and merocyanine dyes.

As the dye image-providing compounds to be used in the present invention, various compounds can be utilized, with dye-releasing redox compounds and dye developers being particularly useful.

Of the dye-releasing redox compounds, those described in the following literatures are illustrated as compounds the oxidized products of which release a dye upon being hydrolyzed with alkali: U.S. Pat. Nos. 4,053,312, 4,055,428, 4,076,529, 4,152,153, 4,135,929, Japanese patent application (OPI) Nos. 149328/78, 104343/76, 46730/78, 130122/79, 3819/78, 12642/81, 16130/81, 16131/81, etc.

Of these, yellow dye-releasing ones are described in U.S. Pat. No. 4,013,633, Japanese patent application (OPI) Nos. 149328/78 and 114930/76, Japanese patent application (OPI) No. 71072/81, *Research Disclosure,* 17630 ('78), ibid., 16475 ('77), etc.

Magenta dye-releasing ones are described in U.S. Pat. Nos. 3,954,476, 3,931,144, 3,932,308, Japanese patent application (OPI) Nos. 23628/78, 106727/77, 65034/79, 161332/79, 4028/80, 36804/80, 134850/80, Japanese patent application (OPI) Nos. 73051/81, 71060/81, West German patent application (OLS) No. 2847371, etc.

Cyan dye-releasing ones are described in U.S. Pat. Nos. 3,942,987, 3,929,760, 4,013,635, Japanese patent application (OPI) Nos. 109928/76, 149328/78, 8827/77, 143323/78, 47823/78, Japanese patent application (OPI) No. 71061/81, etc.

And, as redox compounds with which non-oxidized compounds release a dye as a result of ring closure or the like, there are illustrated those described in U.S. Pat. Nos. 4,139,379, 3,980,479, West German patent application (OLS) Nos. 2,402,900, 2,448,811, etc.

As the dye developer, there can be used those described in various patents such as U.S. Pat. No. 2,983,606 and those described in S. M. Bloom, M. Green, M. Idelson & M. S. Simon; *The Chemistry of Synthetic Dyes,* Vol. 8, pp. 331–387 (compiled by Venkataraman and published by Academic Press, New York, in 1978), etc.

In the photographic film unit of the present invention, any silver halide-developing agent can be used that can cross-oxidize the dye image-providing compound. Such developing agent may be incorporated in an alkaline processing solution or in a suitable layer of a photographic element. Developing agents usable in the present invention are exemplified below: hydroquinones described in Japanese patent application (OPI) No. 16131/81, aminophenols, phenylenediamines, pyrazolidinones (for example, phenidone, 1-phenyl-3-pyrazolidinone, dimezone (1-phenyl-4,4-dimethyl-3-pyrazolidinone), 1-p-tolyl-4-methyl-4-hydroxymethyl-3-pyrazolidinone, 1-(4'-methoxyphenyl)-4-methyl-4-hydroxymethyl-3-pyrazolidinone, 1-phenyl-4-methyl-4-hydroxymethyl-3-pyrazolidinone, etc.), etc. The pyrazolidonones described above are more preferred.

Of these, black-and-white developing agents (particularly pyrazolidinones) capable of reducing formation of stain in an image-receiving layer are generally more preferable than color developing agents of phenylenediamines and the like.

In the case of using the light-sensitive material of the present invention for forming a wash-off relief image or as pan-matrix film, tanning development agents are used. As the agents, there can be used, for example, those conventionally known in the art.

The processing solution contains a base such as sodium hydroxide, potassium hydroxide, sodium carbonate or sodium phosphate and has an alkalinity of 9 or more, preferably 11.5 or more, in pH. The processing solution contains an anti-oxidizing agent such as sodium sulfite, ascorbic acid salt or piperidinohexose reductone, and can contain a silver ion concentration-adjusting agent such as potassium bromide. Further, a thickening agent such as hydroxyethyl cellulose or sodium carboxymethyl cellulose may also be incorporated.

The alkaline processing solution may further contain such compounds which accelerate development or diffusion of dye (e.g., benzyl alcohol).

A spacer layer may be provided between an interlayer and a layer containing a dye image-providing substance as described in Japanese patent application (OPI) No. 52056/80. A silver halide emulsion may be added to an interlayer as described in Japanese patent application No. 144155/79.

As the mordant layer, neutralizing layer, neutralizing rate-controlling layer (timing layer), processing compositon, etc. to be used for the light-sensitive material of the present invention for color diffusion transfer process, those described, for example, in Japanese patent application (OPI) No. 64533/77 are applicable.

EXPERIMENT EXAMPLE (A) Preparation of force-oxidized carbon black:

(a) According to a process of using ozone (gaseous phase: for comparison):

50 g of carbon black having a particle size of 0.085μ (10B, made by Mitsubishi Chemical Industries, Ltd.) was place in a 1 liter glass vessel equipped with a stirrer. Vigorous stirring was conducted to keep the carbon black in a state of being suspended in the air within the vessel. Ozone was introduced thereinto at a rate of 1.775 g per hour to conduct forced oxidation. After the introduction of ozone, stirring was further continued for one hour. After allowing the mixture to stand overnight, a carbon black accumulation was collected.

(b) According to a process of using hydrogen peroxide (liquid phase: for this invention):

A dispersion consisting of 100 g of carbon black having a particle size of 0.085μ (10B, made by Mitsubishi Chemical Industries, Ltd.) and 400 ml of water was heated to 70° C., and 400 ml of a 35% hydrogen peroxide aqueous solution was added dropwise thereto in one hour under stirring. After completion of the dropwise addition, the mixture was maintained at 70° C. and allowed to react for 3 hours. After filtration and washing with water, the product was stirred for 1 hour together with 1 liter of a 3% sodium sulfite solution followed by washing with water and drying.

(c) According to a process of using sodium hypochlorite-1(liquid phase: for this invention):

A dispersion consisting of 150 g of carbon black having a particle size of 0.085μ (10B, made by Mitsubishi Chemical Industries, Ltd.) was heated to 70° C. and, under stirring, 300 ml of 12% sodium hypochlorite solution was dropwise added thereto in 20 minutes. After completion of the dropwise addition, the mixture was kept at 70° C. to react for 3 hours. After filtration and washing of the reaction mixture with water, it was stirred for one hour together with 1 liter of a 3% sodium sulfite solution followed by filtration, washing with water and drying.

(d) According to a process of using sodium hypochlorite-2 (liquid phase: for this invention):

36 g of carbon black having a particle size of 0.060μ (R-450, made by Colombia Carbon Co.) and 375 g of TAMOL SN (2% aqueous dispersion containing a polymer of formaldehyde and sodium aphthalenesulfonate) were heated to 70° C. and, under stirring, 260 ml of a 12% sodium hypochlorite solution was gradually added thereto in 40 minutes. After completion of the dropwise addition, the mixture was kept at 70° C. for 3 hours under stirring. Then, the reaction mixture was cooled to room temperature and, in order to inactivate the remaining sodium hypochlorite, a solution consisting of 21 g of sodium sulfite and 40 ml of water was added thereto followed by stirring for one hour. After adding thereto 675 ml of a 10% gelatin aqueous solution at 40° C., the resulting mixture was cooled to solidify, and was cut into die-like pieces followed by leaving in running water for 2 hours to remove remaining reaction products.

(B) Measurement of the amount of dye (I) adsorbed on carbon black:

0.2 g of portions of carbon black a, b and c having been force-oxidized as described in (a) to (c) above and non-treated carbon black having been exposed to air for a long time (control carbon black e) were respectively added to 40 ml portions of a 1 N KOH aqueous solution containing 0.01% dye (I) followed by stirring at 25° C. for 30 minutes. Subsequently, the supernatant liquid was separated from carbon black using a centrifuge. The amount of dye (I) in the supernatant liquid was determined by comparing the absorption density of the liquid at 654 mμ with that of the original aqueous solution of dye (I). Thus, there were obtained data on adsorption amount given in Table 1 below.

(C) Measurement of dispersibility:

0.1 g of carbon black and 100 ml of water were charged in an Erlenmyer's flask and the mixture was vigorously shaken for 5 minutes (200/min). After the mixture was then allowed to stand for 24 hours, 5 ml of the supernatant was withdrawn and 95 ml of water was added thereto to make the total 100 ml. An absorption of the resulting liquid was measured at a visible region to determine an extinction density at 500 mμ (10 mm cell using water as a control). The thus obtained extinction density was increased by ten times, which was made a dispersibility of carbon black in water.

Results obtained with carbon blacks a (forced oxidation in a gaseous phase, for comparison), b (liquid phase), c (liquid phase), e (non-treated furnace black), f (non-treated channel black) and g (non-treated channel black) are shown in Table 1 below.

TABLE 1

| Carbon Black | Amount of Dye (I) Adsorbed (mg) | Ratio to e (%) | Particle Size (μ) Prior to Forced Oxidation | After Forced Oxidation | Dispersibility |
|---|---|---|---|---|---|
| a (gaseous phase) | 2.2 | 84.6 | 0.085 | 0.084 | 3.2 |
| b (liquid phase) | 1.6 | 61.5 | 0.085 | 0.084 | 8.5 |
| c (liquid phase) | 0.5 | 19.2 | 0.060 | 0.062 | 11.8 |
| e (non-treated furnace) | 2.6 | 100 | 0.085 | — | 0.2 |
| f (non-treated channel) | 6.9 | 276 | 0.024 | — | 1.6 |
| g (non-treated channel) | 13.3 | 532 | 0.013 | — | 1.2 |

As can be noted from the results shown in Table 1 above, the force-oxidized carbon blacks in a liquid phase possess a dispersibility of at least 4 and adsorb dye (I) of less than 75%. Further, per these carbon blaks the particle size is substantially the same prior to and after forced oxidation, contrary to the prior art teaching that inherent oxidation which occurs during preparation is accompanied by a great reduction of the particle size. These differences between carbon black force-oxidized in a liquid phase and non-treated carbon black or carbon black force-oxidized in a gaseous phase result in significant differences in photographic properties as will be shown hereafter.

The present invention will now be described in more detail by the following non-limiting examples.

EXAMPLE 1

On a polyethylene trephthalate support were coated the following layers to prepare a light-sensitive sheet.

(1) A mordant layer containing 3.0 g/m$^2$ of copoly(styrene-N-vinylbenzyl-N,N,N-trihexylammonium chloride) and 3.0 g/m$^2$ of gelatin.

(2) A light-reflecting layer containing 20 g/m$^2$ of titanium dioxide and 2.0 g/m$^2$ of gelatin.

(3) A light-sealed (or sealing) layer containing 2.0 g/m$^2$ of gelatin.

(4) A layer containing 0.44 g/m$^2$ of the following cyan dye-releasing redox compound, 0.09 g/m$^2$ of tricyclohexyl phosphate, 0.008 g/m$^2$ of 2,5-di-t-pentadecylhydroquinone, and 0.8 g/m$^2$ of gelatin.

Cyan dye-releasing redox compound

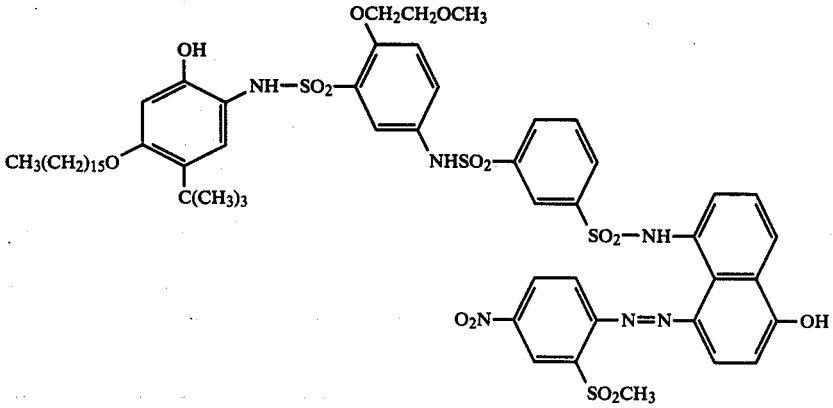

(5) A red-sensitive emulsion layer containing a red-sensitive internal latent image type direct positive silver bromide emulsion (in a silver amount of 1.03 g/m$^2$), 1.2 g/m$^2$ of gelatin, 0.04 mg/m$^2$ of the following nucleating agent, and 0.13 g/m$^2$ of 2-sulfo-5-n-pentadecylhydroquinone sodium salt.

Nucleating agent

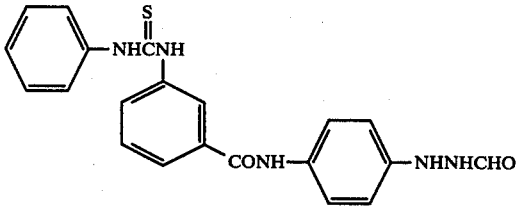

(6) A layer containing 0.43 g/m$^2$ of 2,5-di-t-pentadecylhydroquinone, 0.1 g/m$^2$ of trihexyl phosphate, and 0.4 g/m$^2$ of gelatin.

(7) A layer containing 0.21 g/m$^2$ of a magenta dye-releasing redox compound represented by the following structural formula I, 0.11 g/m$^2$ of a magenta dye-releasing redox compound represented by the following structural formula II, 0.08 g/m$^2$ of tricyclohexyl phosphate, 0.009 g/m$^2$ of 2,5-di-t-pentadecylhydroquinone, and 0.9 g/m$^2$ of gelatin.

Structural formula I:

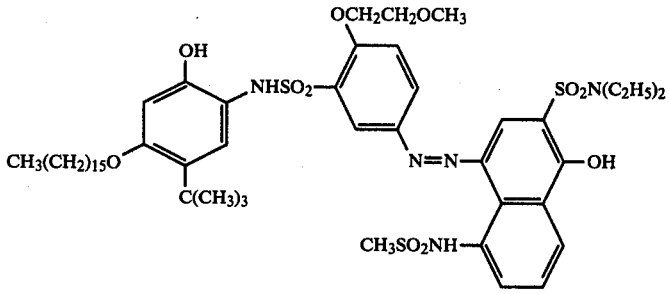

Structural formula II:

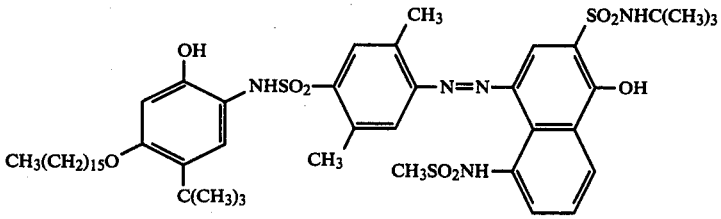

(8) A green-sensitive emulsion layer containing a green-sensitive internal latent image type direct positive silver bromide emulsion (in a silver amount of 0.82 g/m$^2$), 0.9 g/m$^2$ of gelatin, 0.03 mg/m$^2$ of the same nucleating agent as used in layer (5), and 0.08 g/m$^2$ of 2-sulfo-5-n-pentadecylhydroquinone sodium salt.

(9) The same as layer (6).

(10) A layer containing 0.53 g/m$^2$ of a yellow dye-releasing redox compound of the following structure, 0.13 g/m$^2$ of tricyclohexyl phosphate, 0.014 g/m$^2$ of 2,5-di-t-pentadecylhydroquinone, and 0.7 g/m$^2$ of gelatin.

Yellow dye-releasing redox compound

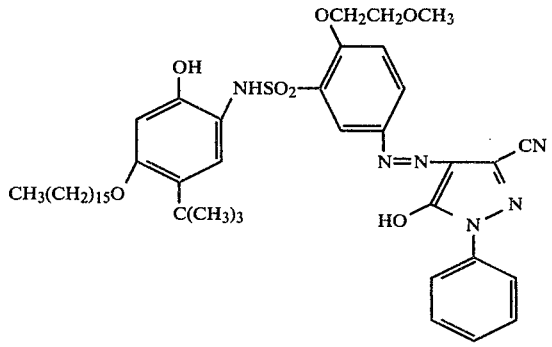

(11) A blue-sensitive emulsion layer containing a blue-sensitive internal latent image type direct positive silver bromide emulsion (in a silver amount of 1.09 g/m$^2$), 1.1 g/m$^2$ of gelatin, 0.04 mg/m$^2$ of the same nucleating agent as used in layer (5), and 0.07 g/m$^2$ of 2-sulfo-5-n-pentadecylhydroquinone sodium salt.

(12) A layer containing 1.0 g/m$^2$ of gelatin.

Light-sensitive sheets prepared by respectively using force-oxidized carbon black a, b, and c as prepared by the processes given above and non-treated carbon black e described in the foregoing Experiment Example in the layer (3) of the above-described stratum structure, were referred to as light-sensitive sheets 1, 2, 3 and 4, respectively.

Each of these light-sensitive sheets 1 to 4 and the following cover sheet were superposed one over the other in a face-to-face relation, and a pressure-rupturable pod retaining the processing solution of the following composition was fixedly positioned thereto to prepare photographic film units.

Construction of cover sheet

On a transparent polyethylene terephthalate support were coated, in sequence, the following layers (1') to (3') to prepare a cover sheet.

(1') A layer containing 22 g/m$^2$ of a copolymer of acrylic acid and butyl acrylate (copolymerization ration: 80/20 by weight) and 0.44 g/m$^2$ of 1,4-bis(2,3-epoxypropoxy)butane.

(2') A layer containing 3.8 g/m$^2$ of acetyl cellulose (producing 39.4 g of acetyl group upon 100 g of acetyl cellulose being hydrolyzed), 0.2 g/m$^2$ of a copolymer of styrene and maleic anhydride (copolymerization ratio: 60/40 by weight; molecular weight: about 50,000), and 0.115 g/m$^2$ of 5-($\beta$-cyanoethylthio)-1-phenyltetrazole.

(3') A layer containing 2.5 g/m$^2$ of a vinylidene chloride/methyl acrylate/acrylic acid terpolymer latex (85:12:3 by weight) and 0.05 g/m$^2$ of a polymethyl methacrylate latex (particle size: 1 to 3 $\mu$m).

| Composition of processing solution | |
|---|---|
| 1-p-Tolyl-4-hydroxymethyl-4-methyl-3-pyrazolidone | 6.9 g |
| Methylhydroquinone | 0.3 g |
| 5-Methylbenzotriazole | 3.5 g |
| Sodium sulfite (anhydrous) | 0.2 g |
| Carboxymethyl cellulose Na salt | 58 g |
| Potassium hydroxide (28% aqueous solution) | 200 cc |
| Benzyl alcohol | 1.5 cc |

-continued

| Composition of processing solution | |
|---|---|
| Carbon black | 150 g |
| Water | 685 cc |

Each of the above-described film units was exposed through a neutral wedge from the cover sheet side, and the processing solution was spread in a thickness of 80$\mu$ at 25° C. by means of a pressure-applying member to obtain a transferred color image. The time for the image to appear and density of the transferred color image measured after one hour through a red (R) filter, green (G) filter or blue (B) filter are tabulated in the following table.

TABLE 2

| Light-Sensitive Sheet | Image-Appearing Time (sec.) | Dmax | | | Dmin | | |
|---|---|---|---|---|---|---|---|
| | | R | G | B | R | G | B |
| 1 (comparison) | 22 | 2.06 | 1.96 | 1.84 | 0.32 | 0.23 | 0.23 |
| 2 | 20 | 2.11 | 1.99 | 1.86 | 0.31 | 0.22 | 0.23 |
| 3 | 19 | 2.15 | 2.02 | 1.90 | 0.30 | 0.22 | 0.22 |
| 4 (control) | 23 | 2.03 | 1.95 | 1.84 | 0.32 | 0.24 | 0.23 |

It is seen from this table that the use of liquid phase-force-oxidized carbon black in the light-sealed (or sealing) layer serves to shorten the image-appearing time and raise Dmax of, particularly, R. Carbon black treated with sodium hypochlorite shows a particularly remarkable reduced Dmin. On the other hand, carbon black, while force-oxidized but in a liquid phase (light sensitive sheet 1), provides substantially the same results as those with light sensitive sheet 4 for contron in which non-treated carbon black was employed. Thus, the photographic material in accordance with the present invention in which carbon black force-oxidized in a liquid phase was employed provides a good transfer image quality.

EXAMPLE 2

Light-sensitive sheets 5 to 8 were prepared by unifying the carbon black-containing light-sealed (or sealing) layer (3) and the layer (4) containing the cyan dye-releasing redox compound used in Example 1, with other stratum structure being the same as in Example 1. Composition of the unified layer:

A layer containing 0.44 g/m$^2$ of the cyan dye-releasing redox compound used in Example 1, 0.09 g/m$^2$ of tricyclohexyl phosphate, 0.008 g/m$^2$ of 2,5-di-t-pentadecylhydroquinone, 2.0 g/m$^2$ of gelatin, and 2.0 g/m$^2$ of each of the aforesaid carbon blacks a, b, c and e.

| Light-sensitive Sheet | 5 | 6 | 7 | 8 | (control) |
|---|---|---|---|---|---|
| Carbon Black | a | b | c | e | |

The light-sensitive sheets were subjected to the same processings as in Example 1, and R, G and B densities of the transferred color images were measured after one hour. Thus, there were obtained the following data.

TABLE 3

| Light-Sensitive Sheet | Dmax | | | Dmin | | |
|---|---|---|---|---|---|---|
| | R | G | B | R | G | B |
| 5 (comparison) | 2.12 | 1.98 | 1.86 | 0.36 | 0.25 | 0.24 |
| 6 | 2.15 | 2.00 | 1.88 | 0.34 | 0.23 | 0.23 |
| 7 | 2.19 | 2.03 | 1.92 | 0.32 | 0.23 | 0.23 |
| 8 (control) | 2.09 | 1.97 | 1.85 | 0.38 | 0.25 | 0.25 |

It is seen from this table that the force-oxidized carbon blacks in a liquid phase which has a dispersibility of at least 4 provide a higher Dmax and a lower D min than the non-treated carbon black e and the force-oxidized carbon black a in a gaseous phase. Light-sensitive sheet 8 using the non-treated carbon black provides a particularly high Dmin of R, which is attributed to the fact that the red-sensitive emulsion layer and the carbon black layer are in contact with each other in this Example. Further, light-sensitive sheet 5 using the force-oxidized carbon black but in a gaseous phase also provides similar results as in light sensitive sheet 8. Taking these results as comparative examples, the improved effects of using the force-oxidized carbon black in a liquid phase in accordance with the present invention are clear.

EXAMPLE 3

Light-sensitive sheets 9 and 10 were prepared by changing the carbon black-containing light-sealed (or sealing) layer (3) and the layer (4) containing the cyan dye-releasing redox compound in Example 1 as described below, with the rest of the stratum structure being the same as in Example 1.

| | Light-sensitive Sheet 9 | Light-sensitive Sheet 10 |
|---|---|---|
| Light-Sealed (or Sealing) Layer (3) | A layer containing 1.2 g/m$^2$ of carbon black force-oxidized by the process (d) in Experiment Example and 0.9 g/m$^2$ of gelatin.*1 | A layer containing 1.2 g/m$^2$ of carbon black (R-450) merely exposed to air for a long time and 0.9 g/m$^2$ of gelatin. |
| Cyan Dye-releasing Redox Compound Containing Layer (4) | A layer containing 0.44 g/m$^2$ of the cyan dye-releasing redox compound used in Example 1, 0.09 g/m$^2$ of tricyclohexyl phosphate, 0.008 g/m$^2$ of 2,5-di-t-pentadecylhydroquinone, 0.8 g/m$^2$ of carbon black force-oxidized by the process (d) of Experiment Example, and 1.1 g/m$^2$ of gelatin.*2 | A layer containing 0.44 g/m$^2$ of the cyan dye-releasing redox compound used in Example 1, 0.09 g/m$^2$ of tricyclohexyl phosphate, 0.008 g/m$^2$ of 2,5-t-pentadecylhydroquinone, 0.8 g/m$^2$ of carbon black (R-450) merely exposed to air for a long time, and 1.1 g/m$^2$ of gelatin. |

*1A gelatin sol obtained by the process (d) was heat-dissolved and coated.
*2A gelatin sol obtained by the process (d) was heat-dissolved and mixed with a coating solution containing the cyan dye-releasing redox compound followed by coating the resulting solution.

The thus obtained light-sensitive sheets were subjected to the same processings as in Example 1 to measure the image-appearing time and densities of R, G and B of transferred images one hour after the processing.

TABLE 4

| Light-Sensitive Sheet | Image-Appearing Time (Sec.) | Dmax | | | Dmin | | |
|---|---|---|---|---|---|---|---|
| | | R | G | B | R | G | B |
| 9 | 17 | 2.15 | 2.01 | 1.90 | 0.32 | 0.23 | 0.23 |
| 10 (control) | 21 | 2.02 | 1.95 | 1.85 | 0.34 | 0.24 | 0.24 |

When adding part of the carbon black to the light-sealed (or sealing) layer and the rest to the layer containing cyan dye-releasing redox compound as in this Example: the force-oxidized carbon black continues to show remarkably improved image-appearing time, Dmax and Dmin (particularly with respect to R).

While the invention has been described in detail and with reference to specific embodiment thereof, it will be apparent to one skilled in the art that various changes and modifications can be made therein without departing from the spirit and scope thereof.

What is claimed is:

1. A photographic light-sensitive material containing carbon black force-oxidized in liquid phase, having a particle size of 0.03μ to 0.12μ and a dispersibility of at least 4.

2. A photographic light-sensitive material comprising:
- a transparent support;
- an image-receiving layer on said support;
- a silver halide emulsion layer on said support, said silver halide emulsion layer being associated with a dye image-providing compound and a pressure-rupturable container retaining a processing solution;
- a layer containing carbon black force-oxidized in liquid phase positioned between said image-receiving layer and said silver halide emulsion layer, said carbon black having a particle size of 0.03μ to 0.12μ and a dispersibility of at least 4.

3. A photographic light-sensitive material comprising:
- a transparent support;
- an image-receiving layer on said support;
- a silver halide emulsion layer on said support, said silver halide emulsion layer being associated with a dye image-providing compound and a pressure-rupturable container retaining a processing solution;

wherein carbon black force-oxidized in liquid phase is incorporated in said processing solution, said carbon black having a particle size of 0.03 to 0.12μ and a dispersibility of at least 4.

4. A wash-off relief image-forming light-sensitive material containing carbon black force-oxidized in liquid phase in an anti-halation layer, said carbon black having a particle size of 0.03μ to 0.12μ and a dispersibility of at least 4.

5. A pan-matrix film containing carbon black force-oxidized in liquid phase in a silver halide emulsion layer, said carbon black having a particle size of 0.03μ to 0.12μ and a dispersibility of at least 4.

6. A photographic light-sensitive material as in claim 1, wherein said carbon black has a particle size of from 0.05 to 0.12μ.

7. A photographic light-sensitive material as in claim 3 wherein said carbon black has a particle size of from 0.05 to 0.12μ.

8. A wash-off relief image-forming light-sensitive material as in claim 4, wherein said carbon black has a particle size of 0.05 to 0.12μ.

9. A pan-matrix film as in claim 5, wherein said carbon black has a particle size of from 0.05 to 0.12μ.

10. A photographic light-sensitive material as in claim 2, wherein said force-oxidized carbon black is prepared by adding an oxidizing agent to an aqueous solution dispersion of the non-treated carbon black and then heating.

11. A photographic light-sensitive material as in claim 10 wherein said oxidizing agent is an hypohalogenite.

12. A photographic light-sensitive material as in claim 11, wherein said hypohalogenite is selected from the group consisting of sodium hypochlorite, sodium hypobromite, sodium hypoiodite, potassium hypochlorite, potassium hypobromite, potassium hypoiodite and calcium hypochlorite.

* * * * *